US008215757B2

(12) United States Patent
Kuribayashi et al.

(10) Patent No.: US 8,215,757 B2
(45) Date of Patent: Jul. 10, 2012

(54) INK JET APPARATUS AND LIQUID CIRCULATING METHOD

(75) Inventors: Yasushi Kuribayashi, Shizuoka-ken (JP); Masashi Hiroki, Kanagawa-ken (JP); Satoshi Kaiho, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 68 days.

(21) Appl. No.: 12/793,940

(22) Filed: Jun. 4, 2010

(65) Prior Publication Data

US 2011/0007105 A1 Jan. 13, 2011

Related U.S. Application Data

(60) Provisional application No. 61/223,823, filed on Jul. 8, 2009.

(51) Int. Cl.
*B41J 2/18* (2006.01)
*B41J 2/175* (2006.01)

(52) U.S. Cl. ..... 347/89; 347/85

(58) Field of Classification Search ..... None
See application file for complete search history.

(56) References Cited

U.S. PATENT DOCUMENTS

2009/0051722 A1* 2/2009 Kaiho ..... 347/17

FOREIGN PATENT DOCUMENTS

JP 2006289955 10/2006
WO WO 2006064040 A1 * 6/2006

* cited by examiner

*Primary Examiner* — Matthew Luu
*Assistant Examiner* — Erica Lin
(74) *Attorney, Agent, or Firm* — Turocy & Watson, LLP

(57) ABSTRACT

According to one embodiment an ink jet apparatus includes, an ink jet head, a first tank, a second tank, a third tank, a first flow channel, a second flow channel, and a flow control mechanism. The first tank is disposed upstream of the ink jet head with respect to a flow of ink. The second tank is disposed downstream of the ink jet head with respect to the flow of ink. The third tank is disposed downstream of the ink jet head with respect to the flow of ink. The first flow channel connects the first tank to the ink jet head and connects the ink jet head to the second tank and the third tank. The second flow channel connects the second tank and the third tank with the first tank. The flow control mechanism controls a pressure state of at least one of the second tank and the third tank.

19 Claims, 10 Drawing Sheets

INK JET APPARATUS AND LIQUID CIRCULATING METHOD

CROSS-REFERENCE TO RELATED APPLICATIONS

This application is based upon and claims the benefit of priority from: U.S. Provisional Application No. 61/223,823 filed on Jul. 8, 2009, the entire contents off which are incorporated herein reference.

FIELD

Embodiments described herein relate generally to an ink jet apparatus and a liquid circulating method.

BACKGROUND

In an ink jet apparatus, a circulative supply unit which supplies ink to an ink jet head while circulating the ink is used as a recovering unit to eliminate air bubbles and foreign substances from around an ink discharge port of the ink jet head.

A system for circulating ink by pressurizing the ink directly by a pump is known. In this system, since the ink circulates in the pump, the ink is subjected to degradation, and the degraded ink is recycled to the head, so that images formed thereby are unstable.

A system for circulating ink by managing a negative pressure in a tank for solving the problem of ink degradation or the like is known. However, with this technology, the ink does not circulate to the ink jet head while returning the ink from a second tank to a first tank.

DETAILED DESCRIPTION

In general, according to one embodiment an ink jet apparatus comprises, an ink jet head, a first tank, a second tank, a third tank, a first flow channel, a second flow channel, and a flow control mechanism. The first tank is disposed upstream of the ink jet head with respect to a flow of ink. The second tank is disposed downstream of the ink jet head with respect to the flow of ink. The third tank is disposed downstream of the ink jet head with respect to the flow of ink. The first flow channel connects the first tank to the ink jet head and connects the ink jet head to the second tank and the third tank. The second flow channel connects the second tank and the third tank with the first tank. The flow control mechanism controls a pressure state of at least one of the second tank and the third tank.

[First Embodiment]

Referring now to FIG. 1 to FIG. 8, an ink jet apparatus 1 according to a first embodiment will be described. In the respective drawings described below, configurations are schematically shown by enlarging, reducing, or omitting as needed.

Figure 1:
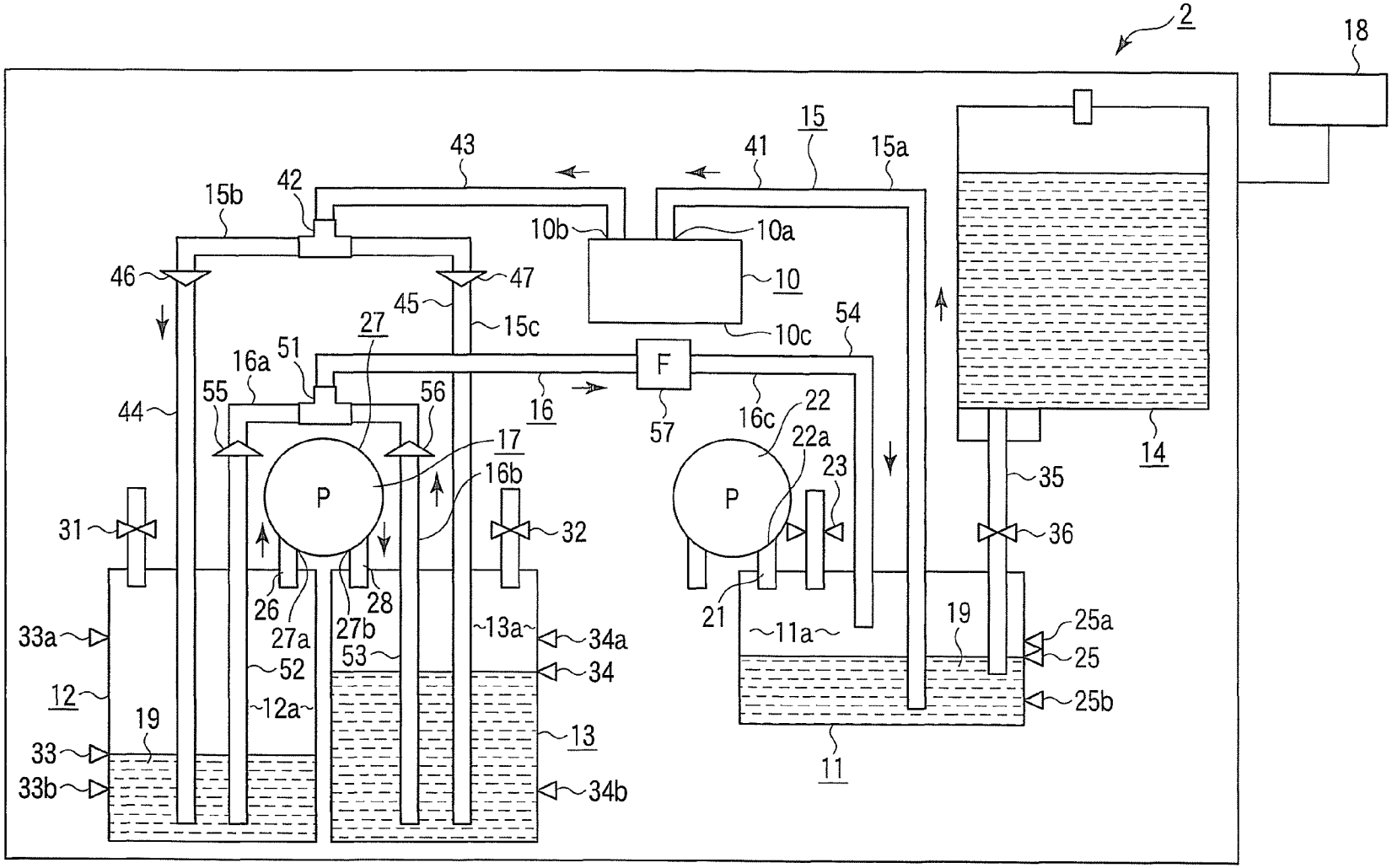
FIG. 1 is an explanatory drawing showing an ink jet apparatus according to a first embodiment.
Figure 2:
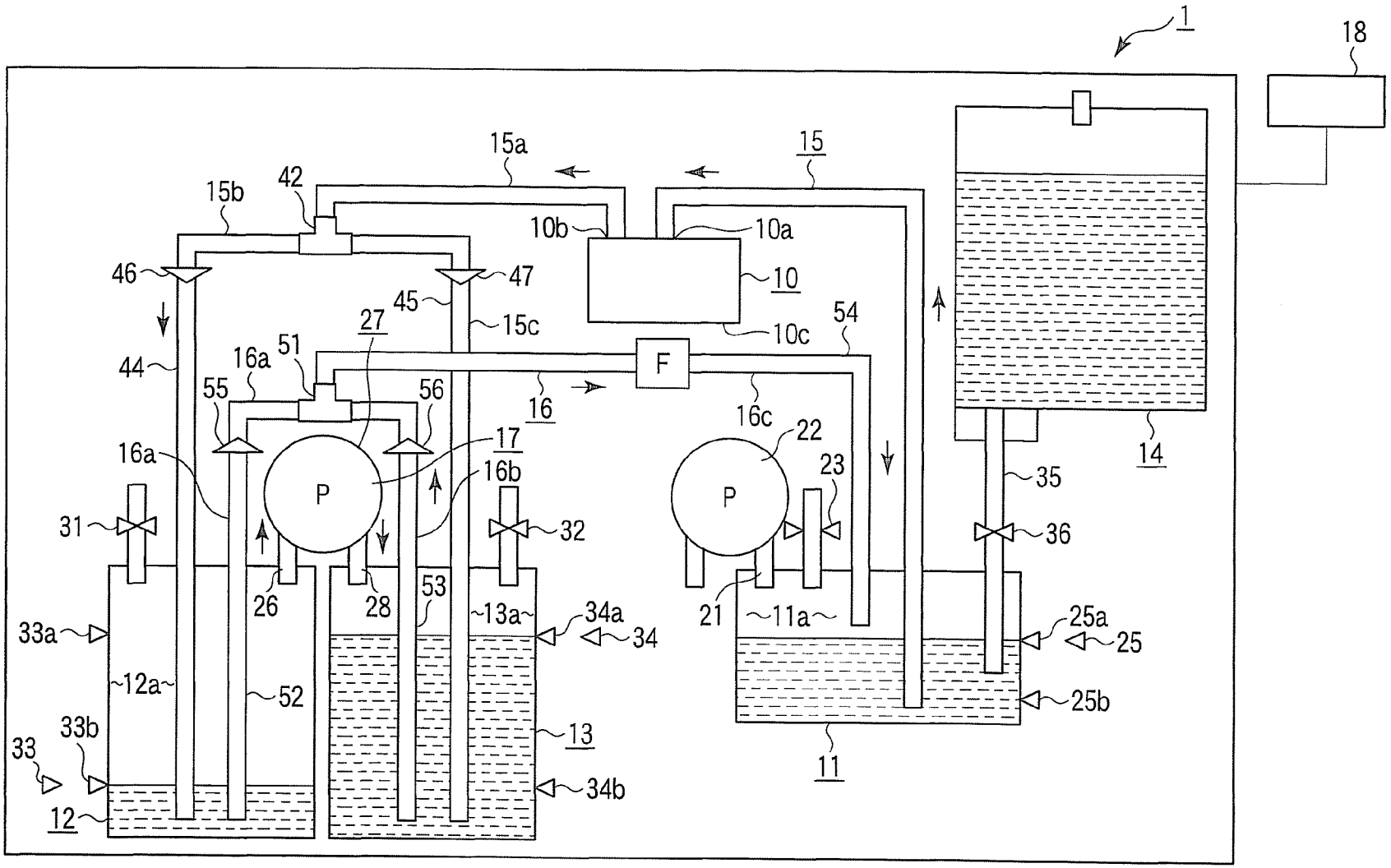
FIG. 2 is an explanatory drawing showing an initial state of the ink jet apparatus.

FIG. 1 is an explanatory drawing showing a structure of the ink jet apparatus 1 according to the first embodiment.

As shown in FIG. 1, the ink jet apparatus 1 includes an ink jet head 10, a first tank 11 disposed on an upstream side of the ink jet head 10 with respect to the direction of flow of ink and configured to supply the ink to the ink jet head 10, a second tank 12 and a third tank 13 disposed on a downstream side of the ink jet head 10 and configured to collect the ink, a replaceable ink tank 14, a first flow channel 15, a second flow channel 16, a flow control mechanism 17 configured to control the flow of the ink by switching the state of air in the second tank 12 and the third tank 13, and a control unit 18 connected to the respective components. The control unit 18 includes a processor, a memory, and so on.

The ink jet head 10, the first tank 11, the second tank 12, and the third tank 13 are communicated by the first flow channel 15 which extends from the first tank 11 through the second tank 12 and the third tank 13 via the ink jet head 10 and the second flow channel 16 which extends from the second tank 12 and the third tank 13 to the first tank 11.

The first flow channel 15 includes a flow channel 15*a* which communicates the first tank 11 and an head entrance 10*a* of the ink jet head 10, a flow channel 15*b* which communicates an head exit 10*b* of the ink jet head 10 and the second tank 12, and a flow channel 15*c* which communicates an head exit 10*b* of the ink jet head 10 and the third tank 13.

The ink jet head 10 includes the head entrance 10*a* connected to the first tank 11, the head exit 10*b* connected to the second tank 12 and the third tank 13, an ink discharge port 10*c* opposing a guide surface of a medium guide, and an ink discharging mechanism (not shown) configured to cause the ink to be discharged from this ink discharge port 10*c*. The ink jet head 10 discharges circulating ink 19 from the ink discharge port 10*c*, and forms an image on a medium which is arranged so as to oppose the ink discharge port 10*c*.

The ink discharging mechanism forms images using any known system.

The first tank 11 stores ink (liquid) and supplies the ink to the ink jet head 10 by circulation described later. The first tank 11 is disposed with a first conduit 21 which communicates with an air layer 11*a* in the first tank 11, and an entrance (suction port) 22*a* of a pump 22 is connected to the first conduit 21. The pump 22 is used for forcedly discharging ink and foreign substances from the ink discharge port 10*c* of the ink jet head 10.

The first tank 11 includes a valve 23 as an opening and closing mechanism which is able to switch the state of the air layer 11*a* in the first tank 11 between an released state and a sealed (blocked) state with respect to atmospheric air. The first tank 11 also includes an ink level sensor 25 as a liquid amount sensing unit for sensing the amount of ink. A predetermined adequate level (upper limit level) 25*a* and a lower limit level 25*b* as a reference for indicating the liquid amount are set to the ink level sensor 25.

The second tank 12 stores ink and collects the ink from the ink jet head 10 by an ink circulation described later. The second tank 12 is disposed with a second conduit 26 which communicates with an air layer 12*a* in the second tank 12, and an entrance (suction port) 27*a* of a pump 27 is connected to the second conduit 26.

The third tank 13 stores ink and collects the ink from the ink jet head 10 by the ink circulation described later. The third tank 13 is disposed with a third conduit 28 which communicates with an air layer 13*a* in the third tank 13, and an exit (compression port) 27*b* of the pump 27 is connected to the third conduit 28.

As the pump 27, for example, a tube pump, or a Roots pump may be used. The pump 27 is capable of switching the direction of airflow inversely. In other words, a suction side and a compression side can be inverted. The pump 27 is configured to be capable of blocking inflow of air during the stop.

The second conduit 26, the third conduit 28, and the pump 27 constitute the flow control mechanism 17 which adjust the internal pressure of the tank. The flow control mechanism 17 causes the pump 27 to feed air from the tank to the outside to lower the pressure to a negative pressure or to feed air from the outside into the tank to raise the pressure to a positive pressure as suction and compression operation. The flow control mechanism 17 sucks and compresses air to control the pressure state according to the control of the control unit 18, thereby causing a flow in the first flow channel 15 and the second flow channel 16. The flows in the first and second flow channels 15 and 16 can be switched by switching the operation between suction and compression.

In the same manner as the first tank 11, the second tank 12 and the third tank 13 have valves 31 and 32, respectively as the opening and closing mechanisms which are able to switch the state of the air layers 12*a* and 13*a* between the released state and the sealed state with respect to the atmospheric air. Both of the valves 31 and 32 do not necessarily have to be disposed and one of them may be omitted.

The second tank 12 includes an ink level sensor 33 (liquid amount sensing unit), and the third tank 13 includes an ink level sensor 34 (liquid amount sensing unit), respectively. For example, an upper limit level 33*a* and a lower limit level 33*b* are set to the second tank 12 as references which indicate the liquid amount and an upper limit level 34*a* and a lower limit level 34*b* are set to the third tank 13 as references which indicate the liquid amount.

The flow control mechanism 17 is controlled according to the results sensed by the ink level sensors 25, 33, and 34, thereby controlling the flows of the air and the ink.

Part of the ink tank 14 is released to the atmospheric air. The ink tank 14 is connected to the first tank 11 by a supply pipe 35. The supply pipe 35 includes a switchable sluice valve 36.

The first flow channel 15 includes a fourth conduit 41 which connects the first tank 11 and the head entrance 10*a*, a branch pipe 42, a fifth conduit 43 which connects the head exit 10*b* and the branch pipe 42, a sixth conduit 44 which connects the branch pipe 42 and the second tank 12, and a seventh conduit 45 which connects the branch pipe 42 and the third tank 13.

The sixth conduit 44 which connects the branch pipe 42 and the second tank 12 includes a back-flow blocking mechanism 46 configured to restrain the flow in the direction from the second tank 12 to the ink jet head 10. The seventh conduit 45 which connects the branch pipe 42 and the third tank 13 includes a back-flow blocking mechanism 47 configured to restrain the flow in the direction from the third tank 13 to the ink jet head 10. The back-flow blocking mechanisms 46 and 47 are, for example, check valves or switchable valves.

In contrast, the second flow channel 16 includes a flow channel 16*a* which connects the second tank 12 and the first tank 11, and a flow channel 16*b* which connects the third tank 13 and the first tank 11. For example, the second flow channel 16 includes a branch pipe 51, an eighth conduit 52 which connects the branch pipe 51 and the second tank 12, a ninth conduit 53 which connects the branch pipe 51 and the third tank 13, and a tenth conduit 54 which connects the first tank 11 and the branch pipe 51.

The eighth conduit 52 which connects the branch pipe 51 and the second tank 12 includes a back-flow blocking mechanism 55 configured to restrain the flow in the direction from the first tank 11 to the second tank 12. The ninth conduit 53 which connects the branch pipe 51 and the third tank 13 includes a back-flow blocking mechanism 56 configured to restrain the flow in the direction from the first tank 11 to the third tank 13. The back-flow blocking mechanisms 55 and 56 are, for example, check valves or switchable valves.

The tenth conduit 54 is disposed with a filter 57 configured to remove foreign substances in the ink.

The control unit 18 is connected to respective components of the apparatus such as the ink level sensors 25, 33 and 34, the valves 23, 31, 32, and 36, the flow control mechanism 17, and the pumps 22 and 27 of the ink jet apparatus 1, and controls the operations of these components. The control unit 18 opens and closes the valves 23, 31, 32, and 36 according to the liquid level sensed by the ink level sensors 25, 33 and 34 for example, and controls the operation of the flow control mechanism 17, thereby controlling the ink flow.

Subsequently, a liquid circulating method of the ink jet apparatus 1 will be described. The operations such as forced discharge, ink filing, circulation and recycling and liquid level correction (liquid amount correction) are controlled by the control unit 18 for example.

[Forced Discharge]

The control unit 18 issues an instruction to close the valve 23 of the first tank 11, and issues an instruction to close the sluice valve 36. The control unit 18 also issues an instruction to close the valve 31 of the second tank 12 and issue an instruction to close the valve 32 of the third tank 13 to drive the pump 22 to feed air from the outside to the first tank 11 with the tank sealed.

Then, a positive pressure is applied to an interior of the first tank 11, and a flow of fluid from the first tank 11 through the fourth conduit 41, the ink jet head 10, the fifth conduit 43, the branch pipe 42, the sixth and seventh conduits 44 and 45, the back-flow blocking mechanisms 46 and 47 to the second tank 12 or the third tank 13 is generated.

In contrast, since the second and third tanks 12 and 13 are in the sealed state in which the valves 31 and 32 are closed, the ink 19 cannot move ahead from the fifth conduit 43, thereby being forcedly discharged by the ink discharge port 10*c* of the ink jet head 10.

The flow from the first tank 11 through the tenth conduit 54, the filter 57, the branch pipe 51, the eighth and ninth conduits 52 and 53, and the back-flow blocking mechanisms 55 and 56 to the second tank 12 and the third tank 13 is restrained by the back-flow blocking mechanisms 55 and 56.

[Initial Ink Filling]

Subsequently, the initial ink filling will be described. As the initial ink filling, the control unit 18 firstly turns the power ON (Act 11). The control unit 18 issues an instruction to release the valve 23 (Act 12). The control unit 18 issues an instruction to release the sluice valve 36 (Act 13). The control unit 18 determines whether or not the ink level sensed by the ink sensor 25 of the ink 19 reaches the upper limit level 25*a* of the first tank 11 (Act 14). The control unit 18 issues an instruction to close the sluice valve 36 (Act 15) if it determines that the ink level sensed by the ink sensor 25 reaches the upper limit level 25*a* (yes in Act 14).

Figure 4:
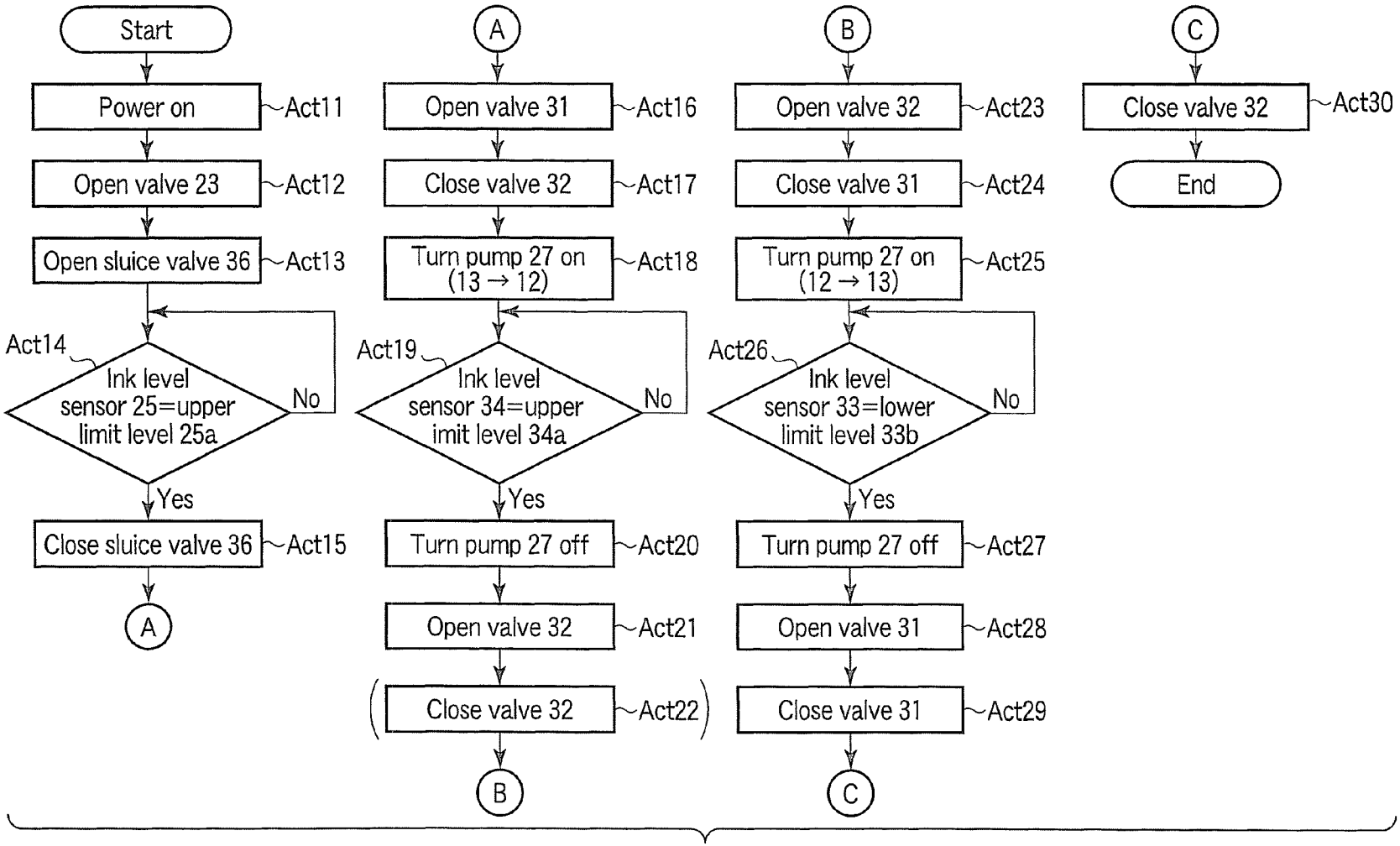
FIG. 4 is a flowchart of initial ink filling in the ink jet apparatus.

After the first tank 11 is filled, the control unit 18 issues an instruction to open the valve 31 of the second tank 12 as shown in the flowchart in FIG. 4 (Act 16). The control unit 18 issues an instruction to close the valve 32 of the third tank 13 (Act 17). The control unit 18 drives the pump 27 to transfer the air in the third tank 13 to the second tank 12 (Act 18). Then, a negative pressure is generated in the third tank 13, and a flow of the ink 19 from the first tank 11, through the fourth conduit 41, the ink jet head 10, the fifth conduit 43, the branch pipe 42, the seventh conduit 45, the back-flow blocking mechanism 47 to the third tank 13 is generated, and the ink is filled in the third tank 13 as filling of ink in the third tank 13.

The control unit 18 determines whether or not the ink level reaches the upper limit level 34*a* sensed by the ink sensor 34 (Act 19). The control unit 18 issues an instruction to stop the pump 27 when the control unit 18 determines that the liquid level sensed by the ink sensor 34 in the third tank 13 reaches the upper limit level 34*a* by the ink level sensor 34 (yes in Act 19) (Act 20). The control unit 18 issues an instruction to open the valve 32 (Act 21) and releases the negative pressure in the third tank 13. Since the interior of the second tank 12 is kept at the atmospheric pressure at this time, little flow of the ink 19 is generated. The first tank 11 and the third tank 13 are both kept at the atmospheric air pressure, and the flow due to the potential head difference is not generated if the upper limit level 34*a* and the upper limit level 25*a* are substantially the same. After a predetermined period after the completion of filling, the control unit 18 issues an instruction to close the valve 32 (Act 22).

After the third tank 13 is filled, the control unit 18 issues an instruction to open the valve 32 of the third tank 13 (Act 23). The control unit 18 also issues an instruction to close the valve 31 of the second tank 12 (Act 24). The control unit 18 issues an instruction to drive the pump 27 to transfer the air in the second tank 12 to the third tank 13 in this state (Act 25). Then, a negative pressure is generated in the second tank 12, and a flow of fluid from the first tank 11, through the fourth conduit 41, the ink jet head 10, the fifth conduit 43, the branch pipe 42, the sixth conduit 44, the back-flow blocking mechanism 46 to the second tank 12 is generated, and the ink is filled in the second tank 12 as filling of ink in the second tank 12.

The control unit 18 determines whether or not the ink level reaches the lower limit level 33*b* by the ink sensor 33 (Act 26). The control unit 18 issues an instruction to stop the pump 27 when the control unit 18 determines that the ink level of the second tank 12 reaches the lower limit level 33*b* by the ink level sensor 33 (yes in Act 26) (Act 27). The control unit 18 issues an instruction to open the valve 31 (Act 28) and releases the negative pressure in the second tank 12. Since the interior of the third tank 13 is kept at the atmospheric pressure at this time, little flow of the ink 19 is generated. When there is a difference between the lower limit level 33*b* and the upper limit level 25*a*, a flow due to the potential head difference occurs. Therefore, the control unit 18 issues an instruction to close the valve 31 and stop the incoming flow (Act 29). Furthermore, the control unit 18 issues an instruction to close the valve 32 (Act 30). Accordingly, a state where the valves 31 and 32 are both closed is assumed after the filling.

Figure 5:
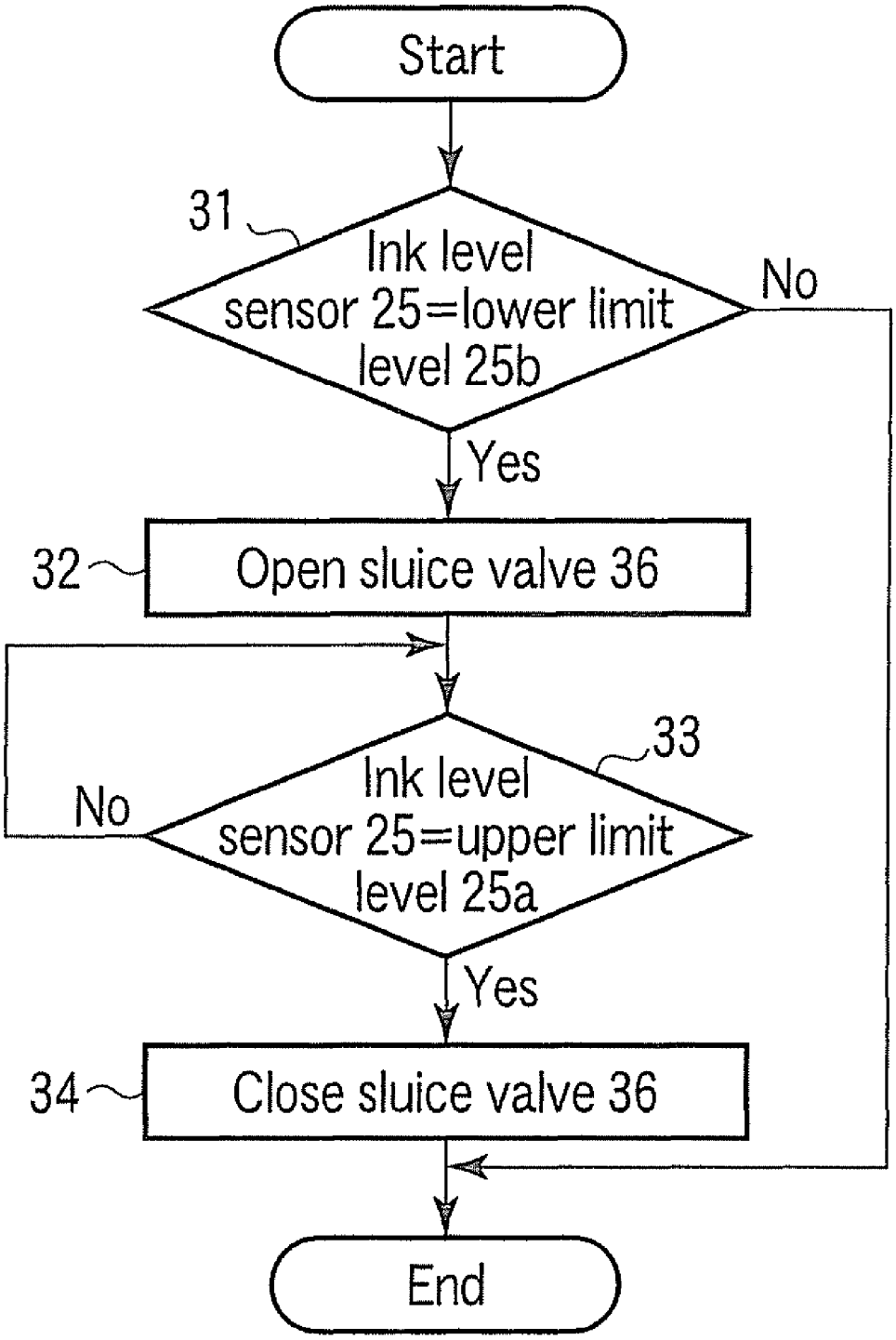
FIG. 5 is a flowchart of ink filling (replenishing) in the ink jet apparatus.

The amount of ink in the first tank 11 reduce during the filling operation with respect to the second tank 12 and the third tank 13. In this case, the control unit 18 performs control as shown in FIG. 5 in parallel. In other words, the control unit 18 determines whether the liquid level sensed by the ink level sensor 25 reaches the lower limit level 25*b* (Act 31). The control unit 18 issues an instruction to release the sluice valve 36 (Act 32) when the liquid level sensed by the ink level sensor 25 reaches to the lower limit level 25*b* (yes in Act 31). The control unit 18 determines whether the liquid level sensed by the ink level sensor 25 reaches the upper limit level 25*a* (Act 33). The control unit 18 issues an instruction to close the sluice valve 36(Act 34) when it determines that the liquid level of the ink reaches the upper limit level 25*a* (yes in Act 33).

[Ink Circulation and Recycling]

Figure 6:
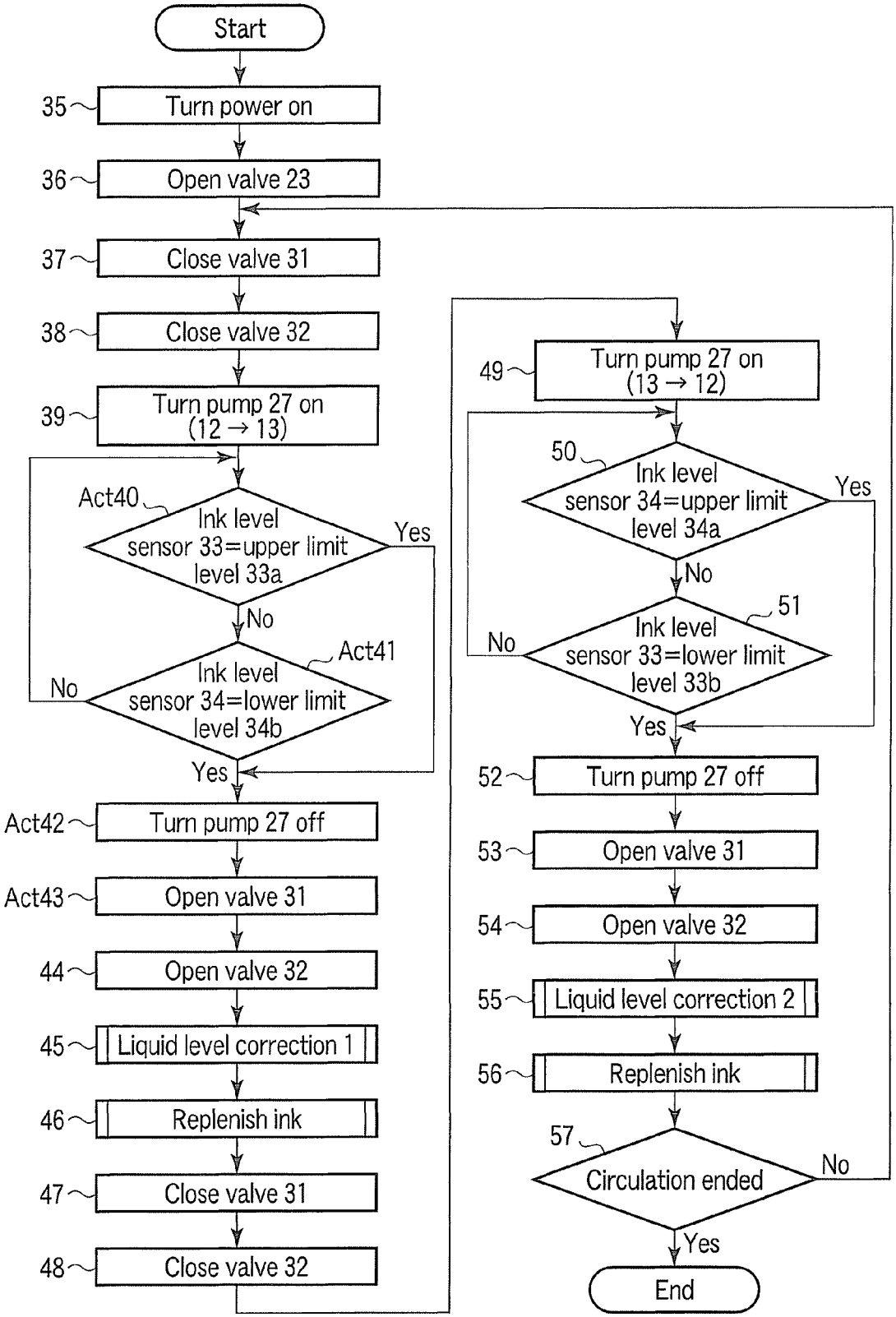
FIG. 6 is a flowchart of the ink circulation and recycling in the ink jet apparatus.

Subsequently, the circulation and recycling of the ink will be described with reference to a flow in FIG. 6. As the initial state (FIG. 2), the liquid level of the ink 19 is assumed to be at the position of the upper limit level 25*a* of the first tank 11, the lower limit level 33*b* of the second tank 12, and at the position of the upper limit level 34*a* of the third tank 13.

The control unit 18 turns the power ON (Act 35). The control unit 18 issues an instruction to release the valve 23 of the first tank 11 (Act 36), and the interior of the first tank 11 becomes the atmospheric pressure. The control unit 18 issues an instruction to close the valve 31 of the second tank 12 (Act 37). The control unit 18 issues an instruction to close the valve 32 of the third tank 13 (Act 38). The control unit 18 drives the pump 27 to transfer the air in the second tank 12 to the third tank 13 in this state (Act 39).

Then, a negative pressure is generated in the interior of the second tank 12, and a flow of the ink 19 from the first tank 11 through the fourth conduit 41, the ink jet head 10, the fifth conduit 43, the branch pipe 42, the sixth conduit 44, and the back-flow blocking mechanism 46 to the second tank 12 is generated. The back-flow blocking mechanisms 46 and 47 allow the flow from the exit of the ink jet head 10 in the direction toward the second tank 12 and the third tank 13.

Simultaneously, a positive pressure is generated in the interior of the third tank 13, and a flow of the ink 19 from the third tank 13 through the back-flow blocking mechanism 56, the branch pipe 51, the tenth conduit 54, the filter 57 to the first tank 11 is generated. In the same manner, the back-flow blocking mechanisms 55 and 56 allow the flow from the second tank 12 and the third tank 13 toward the first tank 11.

At this time, in the second tank 12, an attempt is made to generate a flow from the first tank 11 through the tenth conduit 54, the filter 57, the branch pipe 51, and the eighth conduit 52 to the second tank 12, but it is prevented by the back-flow blocking mechanism 55. Simultaneously, in the third tank 13, an attempt is made to generate a flow from the third tank 13 through the seventh conduit 45, the branch pipe 42, the fifth conduit 43, the ink jet head 10, and the fourth conduit 41 to the first tank 11, but it is prevented by the back-flow blocking mechanism 47.

By the operations as described above, the ink circulating from the first tank 11 through the fourth conduit 41, the ink jet head 10, the fifth conduit 43, the branch pipe 42, the sixth conduit 44, and the back-flow blocking mechanism 46 to the second tank 12 and the ink recycling from the third tank 13 through the back-flow blocking mechanism 56, the fifth conduit 43, the branch pipe 51, the tenth conduit 54, and the filter 57 to the first tank 11 can be performed simultaneously.

Here, if the entrance of the fourth conduit 41 and the exit of the tenth conduit 54 in the first tank 11 are set to the same level, there is a possibility of stagnation of ink due to reusing of ink at the same level. In order to avoid this event, the exit of the tenth conduit 54 is set to a position higher than the entrance of the fourth conduit 41.

The control unit 18 determines whether or not the liquid level reaches the upper limit level 33*a* by the ink level sensor 33 (Act 40) after the pump 27 is driven (Act 39). If the control unit 18 determines that the liquid level does not reach the upper limit level 33*a* (no in Act 40), the control unit 18 determines whether or not the liquid level reaches the lower limit level 34*b* by the ink level sensor 34 (Act 41). If the control unit 18 determines that the liquid level does not reach the lower limit level 34*b* (no in Act 41), the procedure goes back to Act 40.

The reason why the upper limits are set in the respective tanks is to prevent the ink from leaking out from the tanks through the valves 31 and 32 or the entrance and exit of the pump 27, and the reason why the lower limits are set is to prevent the second and third tanks 12 and 13 from becoming empty and hence air bubbles from being transferred to the first tank 11.

If the control unit 18 determines that the ink level sensor 33 of the second tank 12 reaches the upper limit level 33*a* (yes in Act 40), it issues an instruction to stop the pump 27 (Act 42). Also, if the control unit 18 determines that the ink level sensor 34 of the third tank 13 reaches the lower limit level 34*b* (yes in Act 41), it issues an instruction to stop the pump 27 (Act 42). Subsequently, the control unit 18 issues an instruction to open the valve 31 (Act 43). Furthermore, the control unit 18 issues an instruction to open the valve 32 (Act 44), and releases the negative pressure and the positive pressure to stop the flow. If the liquid level in the second tank 12 is at the upper limit level 33*a* (if the ink level sensor 34 of the third tank 13 reaches the lower limit level 34*b* precedently), and if the liquid level in the third tank 13 is at the lower limit level 34*b* (if the ink level sensor 33 of the second tank 12 reaches the upper limit level 33*a* precedently), the procedure goes to the subsequent switching operation (the state shown in FIG. 3).

However, the liquid level in the second tank 12 may be lowered to a level lower than the upper limit level 33*a* (if the ink level sensor 34 of the third tank 13 reaches the lower limit level 34*b* precedently) or the liquid level in the third tank 13 may be increased to a level higher than the lower limit level 34*b* (if the ink level sensor 33 of the second tank 12 reaches the upper limit level 33*a* precedently) due to the loss of the pump 27, the friction in the flow channel of a circulating system and the like.

If such the error is accumulated, the difference between the liquid levels of the second tank 12 and the third tank 13 when switching is reduced, and the time interval to the switching as described later is shortened. In order to prevent such problems, the control unit 18 performs liquid level correction 1 (Act 45) as needed. Detailed description of the liquid level correction 1 (Act 45) will be described later.

If the control unit 18 measures the liquid level in the first tank 11 by the ink level sensor 25 after the liquid level correction 1 and the control unit 18 determines the same to be lower than the lower limit level 25*b*, the control unit 18 replenishes ink (Act 46). The detailed operation of ink replenishment at this time is the same as FIG. 5.

The reason why replenishing the ink when correcting liquid level is that the liquid level in the first tank 11 somewhat fluctuates due to the ink circulation and recycling, and hence the accurate grasp of the ink amount might not be achieved. If the liquid level is corrected as described above, the images may be affected such that the ink circulation of the ink jet head 10 is stopped or the pressure in the vicinity of the ink discharge port 10*c* of the ink jet head 10 is changed due to frequent stopping of the pump 27. Therefore, it is preferable to reduce the number of times of the above-described operation. For example, it is preferable to perform the above-described operation once in several times, when exceeding the allowable tolerance, or when not printing.

Figure 3:
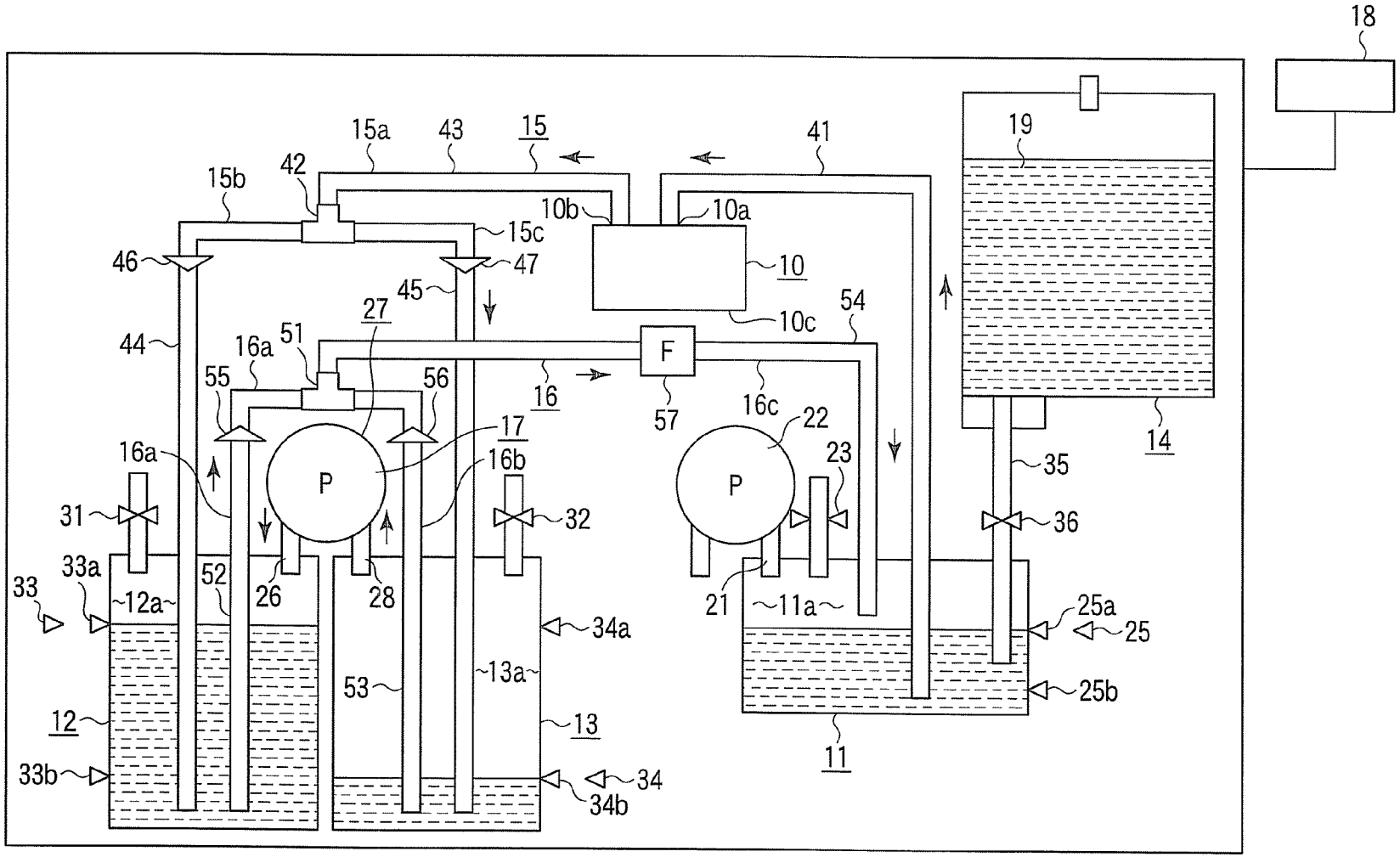
FIG. 3 is an explanatory drawing showing ink circulation and recycling in the ink jet apparatus.

Subsequently, the switching operation will be described with reference to the flow in FIG. 6. As a result of the ink circulation and recycling and the liquid level correction as described above, the level of the ink 19 is at the upper limit level 25*a* in the first tank 11, at the upper limit level 33*a* in the second tank 12, and at the lower limit level 34*b* in the third tank 13 (FIG. 3).

Since the valve 23 of the first tank 11 is in the opened state, the first tank 11 is in the state of the atmospheric pressure. The control unit 18 issues an instruction to close the valve 31 of the second tank 12 (Act 47). The control unit 18 issues an instruction to close the valve 32 of the third tank 13 (Act 48). The control unit 18 drives the pump 27 to transfer the air in the third tank 13 to the second tank 12 in this state (Act 49). In other words, the flow of air between the second tank 12 and the third tank 13 is inverted by the flow control mechanism 17.

Then, a negative pressure is generated in the interior of the third tank 13, and a flow of the ink 19 from the first tank 11 through the fourth conduit 41, the ink jet head 10, the fifth conduit 43, the branch pipe 42, the seventh conduit 45, and the back-flow blocking mechanism 47 to the third tank 13 is generated. Simultaneously, a positive pressure is generated in the interior of the second tank 12, and a flow of the ink 19 from the second tank 12 through the back-flow blocking mechanism 55, the eighth conduit 52, the branch pipe 51, the tenth conduit 54, and the filter 57 to the first tank 11 is generated.

By the operations as described above, the ink circulation from the first tank 11 through the fourth conduit 41, the ink jet head 10, the fifth conduit 43, the branch pipe 42, the seventh conduit 45, and the back-flow blocking mechanism 47 to the second tank 12 and the ink recycling from the third tank 13 through the back-flow blocking mechanism 55, the eighth conduit 52, the branch pipe 51, the tenth conduit 54, and the filter 57 to the first tank 11 can be performed simultaneously.

This is a state in which the second tank 12 and the third tank 13 in the ink circulation and recycling as described above are replaced and this is achieved only by switching the direction of flow of the air of the pump 27. In this manner, by repeating the operation to invert the flow of the air from the second tank 12 to the third tank 13 by the pump (the flow control mechanism), the circulation and recycling can be performed continuously.

The control unit 18 determines whether or not the liquid level reaches the upper limit level 34*a* by the ink level sensor 34 (Act 50) after the pump 27 is driven (Act 49). If the control unit 18 determines that the liquid level does not reach the upper limit level 34*a* (no in Act 50), the control unit 18 determines whether or not the liquid level reaches the upper limit level 33*a* by the ink level sensor 33 (Act 51). If the control unit 18 determines that the liquid level does not reach the upper limit level 33*a* (no in Act 51), the procedure goes back to Act 50.

If the control unit 18 determines that the ink level sensor 34 of the third tank 13 reaches the upper limit level 34*a* (yes in Act 50), the control unit 18 issues an instruction to stop the pump 27 (Act 52). Also, if the control unit 18 determines that the ink level sensor 33 of the second tank 12 reaches the lower limit level 33*b* (yes in Act 51), the control unit 18 issues an instruction to stop the pump 27 (Act 52).

Since Act 53, Act 54, and Act 56 are the same as Act 43, Act 44, and Act 46, the description will be omitted. Detailed description about liquid level correction 2 of Act 55 will be described later.

From Act 47 to Act 56 correspond to the switching operation.

The control unit 18 determines whether or not the circulation is ended after Act 56 (Act 57). If the control unit 18 determines that the circulation is not ended (no in Act 57), the control unit 18 goes back to Act 37.

[Liquid level Correction 1]

Figure 7:
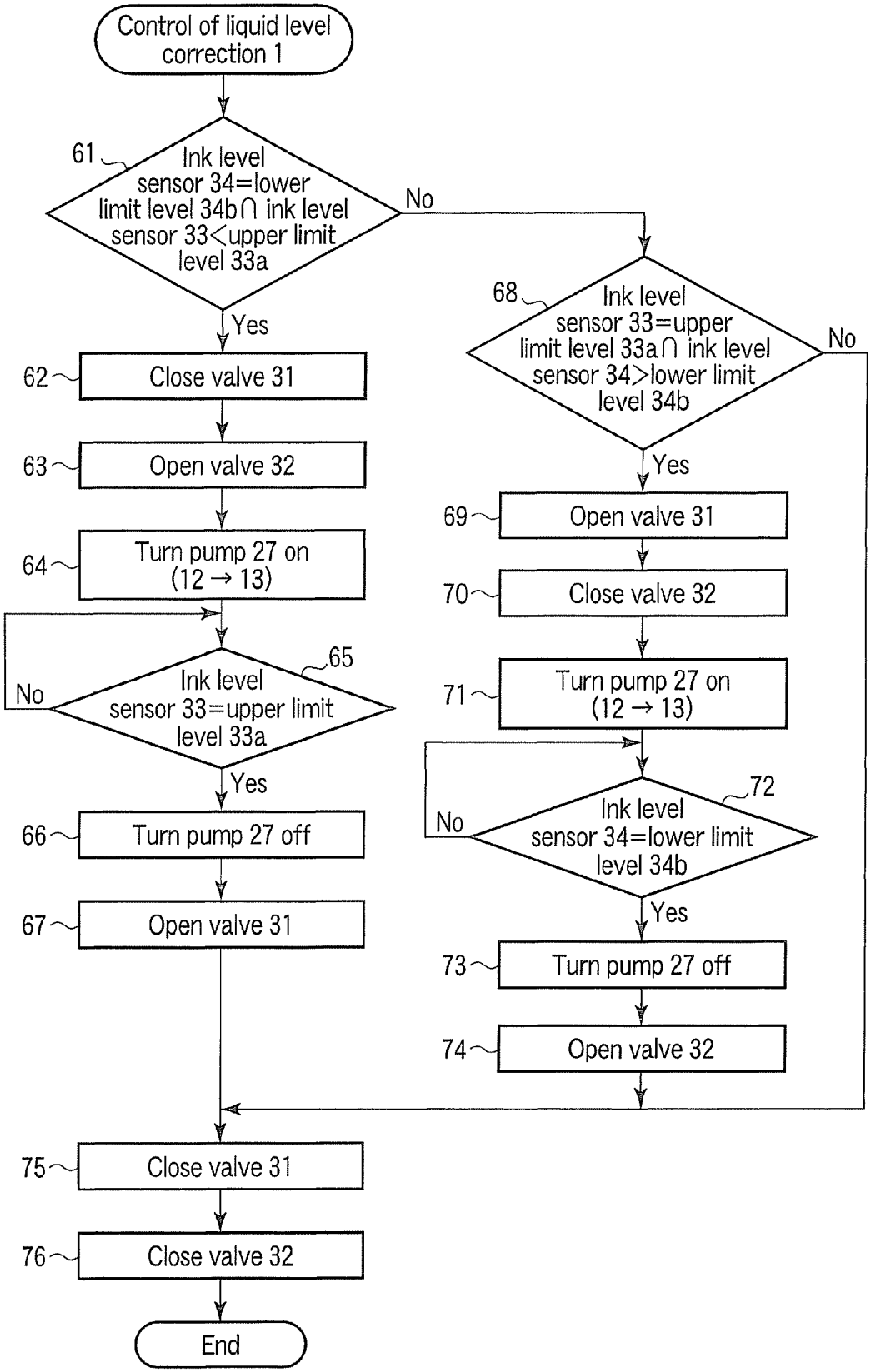
FIG. 7 is a flowchart of ink level correction 1 of the ink jet apparatus.

The liquid level correction 1 will be described referring to the flow in FIG. 7. The control unit 18 determines whether or not the level sensed by the ink level sensor 34 reaches the lower limit level 34*b* and the level sensed by the ink level sensor 33 is lower than the upper limit level 33*a* (Act 61). If the control unit 18 determines that the ink level sensor 34 of the third tank 13 reaches the lower limit level 34*b* and the liquid level in the second tank 12 is lower than the upper limit level 33*a* (yes in Act 61), the control unit 18 issues an instruction to close the valve 31 (Act 62). Also, the control unit 18 issues an instruction to open the valve 32 (Act 63). The control unit 18 drives the pump 27 to transfer the air in the second tank 12 to the third tank 13 (Act 64).

Then, a negative pressure is generated in the interior of the second tank 12, and a flow of the ink 19 from the first tank 11 through the fourth conduit 41, the ink jet head 10, the fifth conduit 43, the branch pipe 42, the sixth conduit 44, the back-flow blocking mechanism 46 to the second tank 12 is generated. The control unit 18 determines whether or not the liquid level reaches the upper limit level 33*a* by the ink level sensor 33 (Act 65). The control unit 18 determines repeatedly until it determines that the liquid level reaches the upper limit level 33*a* by the ink level sensor 33.

The control unit 18 issues an instruction to turn OFF the pump 27 (Act 66) if it determines that the liquid level reaches the upper limit level 33*a* by the ink level sensor 33 (yes in Act 65). Subsequently, the control unit 18 issues an instruction to open the valve 31 (Act 67). During this period, the air from the second tank 12 is transferred to the third tank 13. However, since the valve 32 is opened, the pressure in the third tank 13 is kept substantially at the atmospheric air pressure (little flow is generated).

If the control unit 18 cannot determine that the ink level sensor 34 of the third tank 13 reaches the lower limit level 34*b* and the liquid level in the second tank 12 is lower than the upper limit level 33*a* (no in Act 61), the control unit 18 determines whether or not the ink level sensor 33 of the second tank 12 reaches the upper limit level 33*a* and the liquid level in the third tank 13 is higher than the lower limit level 34*b* (Act 68). If the control unit 18 determines that the ink level sensor 33 of the second tank 12 reaches the upper limit level 33*a* and the liquid level in the third tank 13 is higher than the upper limit level 34*a* (yes in Act 68), the control unit 18 issues an instruction to open the valve 31 (Act 69). The control unit 18 issues an instruction to close the valve 32 (Act 70). Subsequently, the control unit 18 drives the pump 27 to transfer the air in the second tank 12 to the third tank 13 (Act 71). A positive pressure is generated in the interior of the third tank 13, and a flow of the ink 19 from the third tank 13 through the back-flow blocking mechanism 56, the ninth conduit 53, the branch pipe 51, the tenth conduit 54, and the filter 57 to the first tank 11 is generated.

The control unit 18 determines whether or not the liquid level reaches the lower limit level 34*b* by the ink level sensor 34 (Act 72). The control unit 18 determines repeatedly until it determines that the liquid level reaches the lower limit level 34*b* by the ink level sensor 34. The control unit 18 issues an instruction to turn OFF the pump 27 (Act 73) if it determines that the liquid level reaches the lower limit level 34*b* by the ink level sensor 34 (yes in Act 72). Subsequently, the control unit 18 issues an instruction to open the valve 32 (Act 74). During this period, the air from the second tank 12 is transferred to the third tank 13. However, since the valve 31 is opened, the pressure in the second tank 12 is kept substantially at the atmospheric air pressure (little flow is generated).

If the control unit 18 cannot determine that the ink level sensor 33 of the second tank 12 reaches the upper limit level 33*a* and the liquid level of the third tank 13 is higher than the upper limit level 34*a* after Act 67 and Act 74, and in Act 68 (no in Act 68), it issues an instruction to close the valve 31 (Act 75). The control unit 18 also issues an instruction to close the valve 32 (Act 76).

The reason why replenishing the ink when correcting liquid level is that the liquid level of the first tank 11 somewhat fluctuates due to the ink circulation and recycling, and hence the accurate grasp of the ink amount might not be achieved. If the liquid level is corrected as described above, the images may be affected such that the ink circulation of the ink jet head 10 is stopped or the pressure in the vicinity of the ink discharge port 10*c* of the ink jet head 10 is changed due to frequent stopping of the pump 27. Therefore, it is preferable to reduce the number of times of the above-described operation. For example, it is preferable to perform the above-described operation once in several times, when exceeding the allowable tolerance, or when not printing.

[Liquid level Correction 2]

Figure 8:
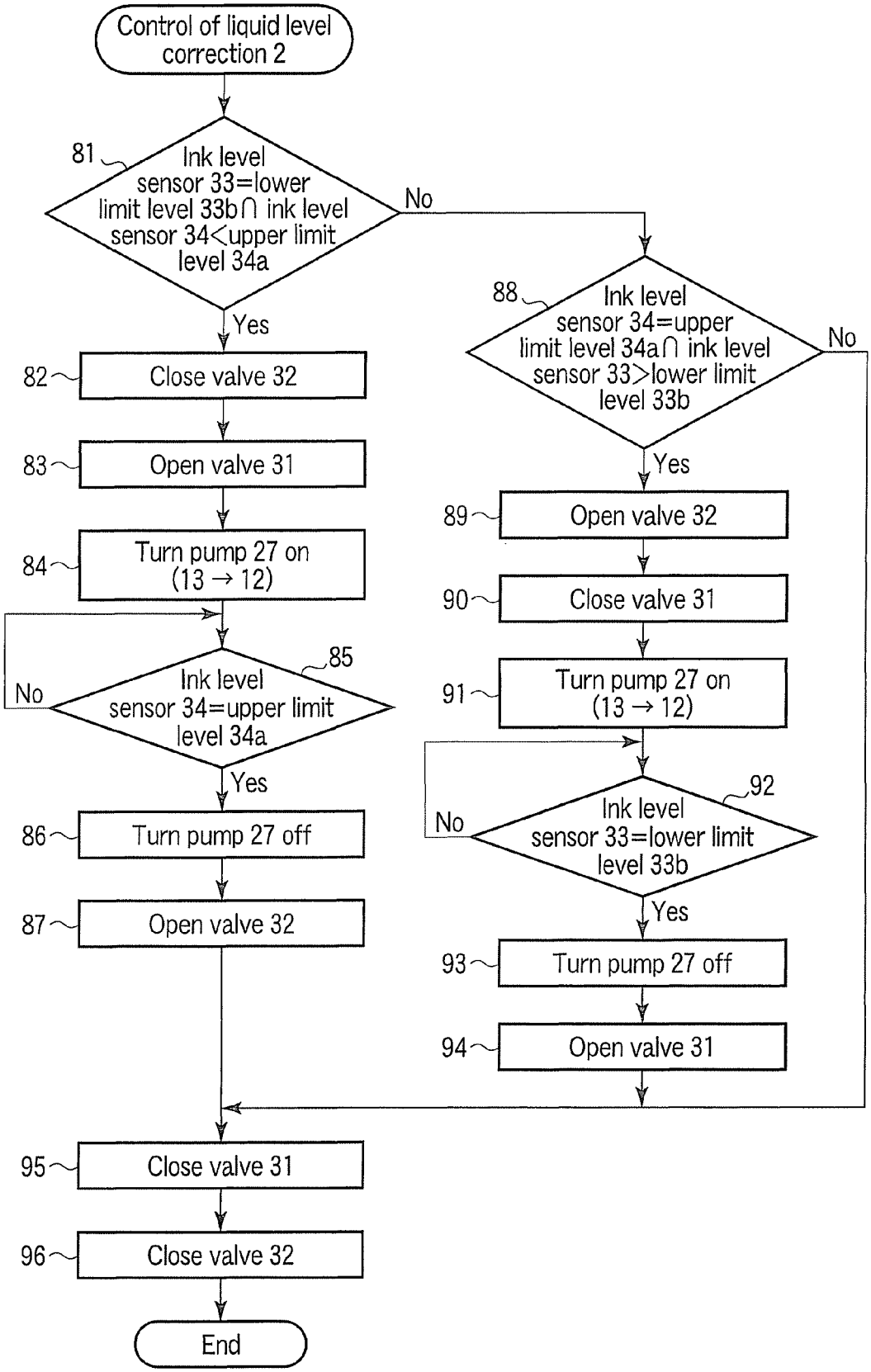
FIG. 8 is a flowchart of ink level correction 2 of the ink jet apparatus.

The liquid level correction 2 will be described referring to the flow in FIG. 8.

The control unit 18 determines whether or not the level sensed by the ink level sensor 33 reaches the lower limit level 33*b* and the level sensed by the ink level sensor 34 is lower than the upper limit level 34*a* (Act 81). If the control unit 18 determines that the ink level sensor 33 of the second tank 12 reaches the lower limit level 33*b* and the liquid level in the third tank 13 is lower than the upper limit level 34*a* (yes in Act 81), it issues an instruction to close the valve 32 (Act 82). The control unit 18 also issues an instruction to open the valve 31 (Act 83). The control unit 18 drives the pump 27 to transfer the air in the third tank 13 to the second tank 12 (Act 84).

Then, a negative pressure is generated in the interior of the third tank 13, and a flow of the ink 19 from the first tank 11 through the fourth conduit 41, the ink jet head 10, the fifth conduit 43, the branch pipe 42, the seventh conduit 45, and the back-flow blocking mechanism 47 to the third tank 13 is generated. The control unit 18 determines whether or not the liquid level reaches the upper limit level 34*a* by the ink level sensor 34 (Act 85). The control unit 18 determines repeatedly until it determines that the liquid level reaches the upper limit level 34*a* by the ink level sensor 34.

The control unit 18 issues an instruction to turn OFF the pump 27 (Act 86) if it determines that the liquid level reaches the upper limit level 34*a* by the ink level sensor 34 (yes in Act 85). Subsequently, the control unit 18 issues an instruction to open the valve 31 (Act 87). During this period, the air from the third tank 13 is transferred to the second tank 12. However, since the valve 31 is opened, the pressure in the second tank 12 is kept substantially at the atmospheric air pressure (little flow is generated).

If the control unit 18 cannot determine that the ink level sensor 33 of the second tank 12 reaches the lower limit level 33*b* and the liquid level in the third tank 13 is lower than the upper limit level 34*a* (no in Act 81), the control unit 18 determines whether or not the ink level sensor 34 of the third tank 13 reaches the upper limit level 34*a* and the liquid level in the second tank 12 is higher than the lower limit level 33*b* (Act 88). If the control unit 18 determines that the ink level sensor 34 of the third tank 13 reaches the upper limit level 34*a* and the liquid level in the second tank 12 is higher than the upper limit level 33*a* (yes in Act 88), the control unit 18 issues an instruction to open the valve 32 (Act 89). The control unit 18 issues an instruction to close the valve 31 (Act 90). Then, the control unit 18 drives the pump 27 to transfer the air in the third tank 13 to the second tank 12 (Act 91). A positive pressure is generated in the interior of the second tank 12, and a flow of the ink 19 from the second tank 12 through the back-flow blocking mechanism 55, the eighth conduit 52, the branch pipe 51, the tenth conduit 54, and the filter 57 to the first tank 11 is generated.

The control unit 18 determines whether or not the liquid level reaches the lower limit level 33*b* by the ink level sensor 33 (Act 92). The control unit 18 determines repeatedly until it determines that the liquid level reaches the lower limit level 33*b* by the ink level sensor 33. The control unit 18 issues an instruction to turn OFF the pump 27 (Act 93) if it determines that the liquid level reaches the lower limit level 33*b* by the ink level sensor 33 (yes in Act 92). Subsequently, the control unit 18 issues an instruction to open the valve 31 (Act 94). During this period, the air from the third tank 13 is transferred to the second tank 12. However, since the valve 32 is opened, the pressure in the third tank 13 is kept substantially at the atmospheric air pressure (little flow is generated).

After Act 87, after Act 94, and if the control unit 18 cannot determine that the ink level sensor 34 of the third tank 13 reaches the upper limit level 34*a* and the liquid level in the second tank 12 is higher than the upper limit level 33*a* in Act 88 (no in Act 88), it issues an instruction to close the valve 31 (Act 95). The control unit 18 also issues an instruction to close the valve 32 (Act 96).

By repeating the switching operations described above alternately, the ink circulation is achieved substantially continuously without stopping the ink circulation in the ink jet head 10 for a long time. The expression "substantially continuously" is used because the circulation is temporarily stopped when changing the direction of flow of the fluid (air) in the pump 27 or during the liquid level correction.

It is also possible to omit one of the valves 31 and 32 of the second tank 12 and the third tank 13. For example, it is assumed that the valve 31 is omitted and hence the second tank 12 is always in the sealed state. Changes resulted from the omission of the valve 31 are methods of the filling of ink, the liquid level correction, and the switching operation.

If there are both the valves 31 and 32, the ink can be filled from either one of the tanks. However, if the valve 31 is omitted, the ink is filled from the third tank 13 where the valve 32 exists. The control unit 18 issues an instruction to open the valve 23 of the first tank 11, and drives the pump 27 to transfer air in the third tank 13 to the second tank 12 with the valve 32 of the third tank 13 closed. Accordingly, a negative pressure is generated in the interior of the third tank 13, and a flow of the ink 19 from the first tank 11 through the fourth conduit 41, the ink jet head 10, the fifth conduit 43, the branch pipe 42, the seventh conduit 45, and the back-flow blocking mechanism 47 to the third tank 13 is generated. If the ink level sensor 34 of the third tank 13 reaches the upper limit level 34*a*, the control unit 18 issues an instruction to stop the pump 27, and also issues an instruction to open the valve 32, thereby releasing the negative pressure in the third tank 13. Since the second tank 12 is in the sealed state at this time, a positive pressure is generated by the transfer of the air. Since the tank is empty, the air in the tank flows from the second tank 12 through the back-flow blocking mechanism 55, the eighth conduit 52, the branch pipe 51, the tenth conduit 54, and the filter 57 to the first tank 11. Although the air is fed to the first tank 11, since the first tank 11 is released to the atmospheric air by the valve 23, the pressure in the tank does not change. Since there is a probability of generation of air bubbles due to air generated if the tenth conduit 54 comes into contact with the liquid surface of the first tank 11, it is preferable to avoid the contact with the liquid surface as much as possible.

As regards the liquid level correction, the liquid level is corrected according to the third tank 13 where the valve 32 exists. In order to correct the liquid level so as to avoid the ink 19 in the second tank 12 from overflowing from the second tank 12, it is preferable to adjust the liquid level in the second tank 12 when the ink level sensor 34 of the third tank 13 reaches the upper limit level 34*a*.

If the control unit 18 determines that the ink level sensor 34 of the third tank 13 reaches the upper limit level 34*a* and the liquid level in the second tank 12 is lowered to a level lower than the lower limit level 33*b*, the control unit 18 issues an instruction to open the valve 32 and drives the pump 27 to transfer the air in the second tank 12 to the third tank 13. Accordingly, a negative pressure is generated in the interior of the second tank 12 and a flow of the ink 19 from the first tank 11 through the fourth conduit 41, the ink jet head 10, the fifth conduit 43, the branch pipe 42, the sixth conduit 44, and the back-flow blocking mechanism 46 to the second tank 12 is generated. This operation is performed until the ink level reaches the liquid level 33*b*. During this period, the air from the second tank 12 is transferred to the third tank 13. However, since the valve 32 is opened, the pressure in the third tank 13 is kept substantially at the atmospheric air pressure.

If the control unit 18 determines that the ink level sensor 34 of the third tank 13 reaches the upper limit level 34*a* and the liquid level in the second tank 12 exceeds the liquid level 33*b*, the control unit 18 issues an instruction to open the valve 32 and drives the pump 27 to transfer the air in the third tank 13 to the second tank 12. Accordingly, a positive pressure is generated in the interior of the second tank 12, and a flow of the ink 19 from the second tank 12 through the back-flow blocking mechanism 55, the eighth conduit 52, the branch pipe 51, the tenth conduit 54, and the filter 57 to the first tank 11 is generated. This operation is performed until the ink level reaches the lower limit level 33*b*. During this period, the air from the third tank 13 is transferred to the second tank 12. However, since the valve 32 is opened, the pressure in the second tank 12 is kept substantially at the atmospheric air pressure.

As regards the switching operation, if the valves 31 and 32 exist in the both second and third tanks 12 and 13, the valves are opened when switching to remove the positive pressure and the negative pressure. However, if the valve exists only in one of the tanks, the flow is inverted immediately after the pump 27 is stopped. Alternatively, the flow of the pump is inverted after only one of the valves is opened.

The timing of the switching operation is described to be until the ink level in the second (third) tank 12 (13) reaches the upper limit level 33*a* (34*a*), or until the ink level in the third (second) tank 13 (12) reaches the lower limit level 34*b* (33*b*). However, since the reference of the liquid level correction is one of the tanks (the third tank 13 in this case), it is also possible to switch if the liquid level in one of the tanks reaches the upper limit level or the lower limit level. In this case as well, since the liquid level in the second tank 12 may exceed the upper limit level 33*a* to cause the ink to overflow from the tank due to accumulated errors, it is preferable to measure the liquid level in the second tank 12 as well. It is not necessary if there is provided a sufficient capacity margin in the tank.

According to this embodiment, the following effects are achieved. The ink can be returned from the downstream tank to the upstream tank while circulating the ink through the head without pressurizing the ink directly with the pump. Therefore, since the ink does not circulate in the pump, the ink can hardly be degraded, so that images formed thereby may be stabilized. In addition, by circulating the ink, air bubbles or foreign substances may be eliminated from the periphery of the ink discharge port of the ink jet head 10. Furthermore, since the circulation and recycling can be performed simultaneously, higher efficiency is expected.

Also, by repeating the switching operations for inverting the flow of the air between the second tank 12 and the third tank 13 alternately, the ink circulation is achieved continuously without stopping the ink circulation in the ink jet head 10 for a long time.

In addition, only by switching the operation of the flow control mechanism 17 according to the liquid levels in the respective tanks 11, 12, and 13, the liquid level correction is easily achieved.

[Second Embodiment]

Figure 9:
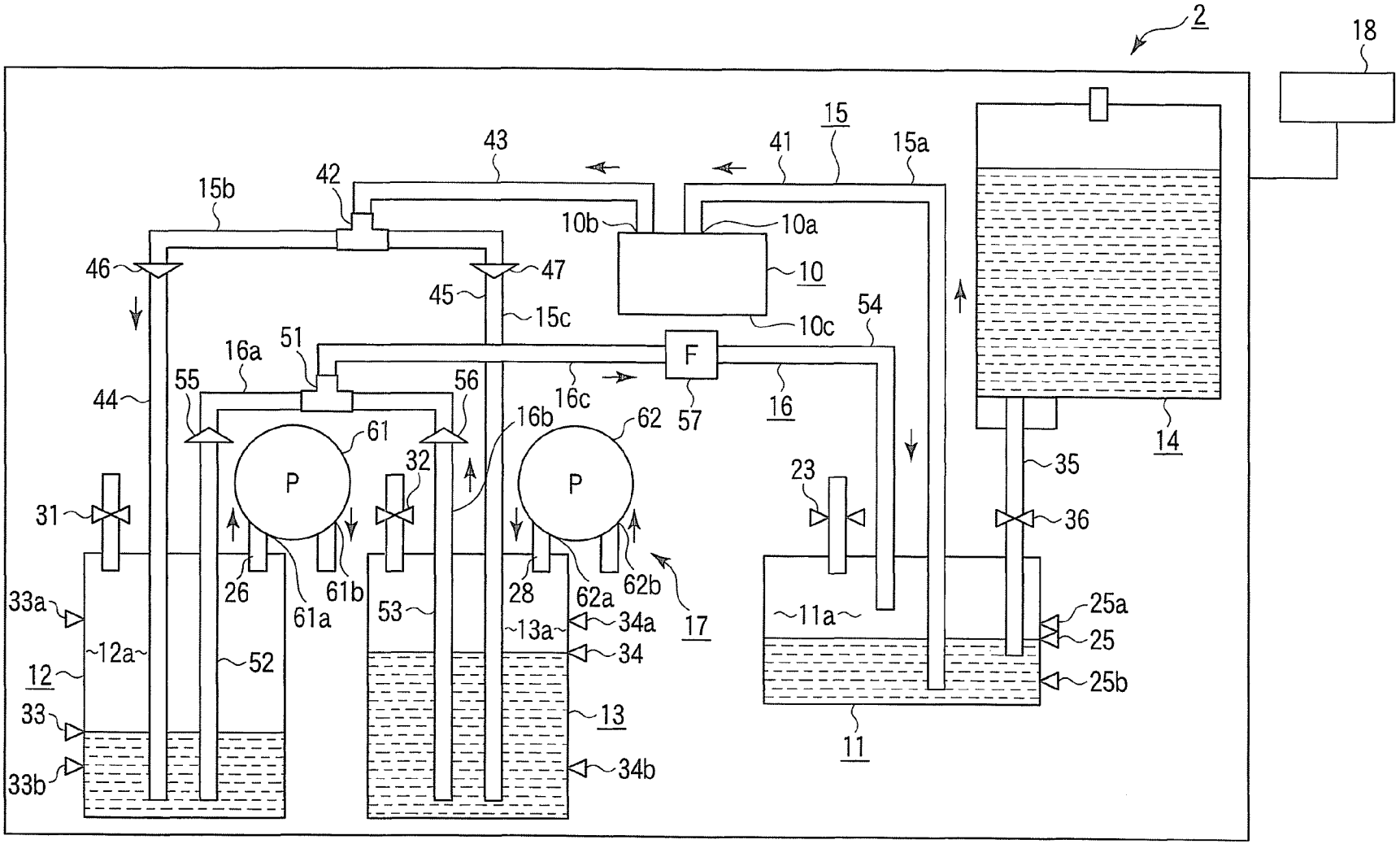
FIG. 9 is an explanatory drawing showing an ink jet apparatus according to a second embodiment.

Referring now to FIG. 9, an ink jet apparatus 2 according to a second embodiment will be described. The ink jet apparatus 2 in the second embodiment is the same as the ink jet apparatus 1 according to the first embodiment except for the configuration of the flow control mechanism 17, thus the overlapped description will be omitted.

In the ink jet apparatus 2 according to the second embodiment, the flow control mechanism 17 includes first and second pumps 61 and 62 which are able to switch the direction of flow of the fluid. The two first and second pumps 61 and 62 are connected respectively to the control unit 18 and are adapted to be controllable individually.

The first pump 61 is connected at one port 61*a* to the second conduit 26 which can suck and compress the air layer 12*a* in the second tank 12, and is released at the other port 61*b* to the atmospheric air.

The second pump 62 is connected at one port 62*a* to the third conduit 28 which can suck and compress the air layer 13*a* in the third tank 13, and is released at the other port 62*b* to the atmospheric air.

In other words, although the second tank 12 and the third tank 13 are connected by the one pump 27 in the first embodiment, the different first and second pumps 61 and 62 each connected at one end to the outside are disposed individually in the second and third tanks 12 and 13 in the ink jet apparatus 2 in this embodiment.

In the ink jet apparatus 2 configured as described above, if a negative pressure is applied to the one (feeding air from the tank to the outside) and a positive pressure is applied to the other (feeding air from the outside to the tank), the same ink circulation and recycling as in the first embodiment are obtained. It is preferable to set the first pump 61 and the second pump 62 to have the same pump capacity.

In the ink jet apparatus 2, an ink circulating flow rate is increased by applying a negative pressure to both the different two pumps 61 and 62 with the first tank 11 opened and the second tank 12 and the third tank 13 sealed.

In this ink jet apparatus 2, the ink is circulated and recycled continuously by repeatedly controlling the different two pumps 61 and 62 to bring the one to a negative pressure when the other one has a positive pressure and bring the one to a positive pressure when the other one has a negative pressure.

In the ink jet apparatus 2, the ink jet head 10 is caused to forcedly discharge the ink by applying a positive pressure to both the different two pumps 61 and 62 with the first tank 11 sealed and the second tank 12 and the third tank 13 also sealed.

For example, the control unit 18 issues an instruction to close the valve 23 of the first tank 11, and issues an instruction to close the valve 31 of the second tank 12. Accordingly, by applying a positive pressure to both the first and second pumps 61 and 62 with the valve 32 of the third tank 13 closed (feeding air from the outside to the tank), a flow of the ink 19 from the second tank 12 and third tank 13 through the back-flow blocking mechanisms 55 and 56, the eighth conduit 52, the ninth conduit 53, the branch pipe 51, the tenth conduit 54, and the filter 57 to the first tank 11 is generated.

Since the first tank 11 is in the sealed state and hence the amount of the ink 19 increases, the air in the first tank 11 is compressed and a positive pressure is generated. Therefore, a flow from the first tank 11 through the fourth conduit 41, the ink jet head 10, the fifth conduit 43, the branch pipe 42, the sixth conduit 44, the seventh conduit 45, and the back-flow blocking mechanisms 46 and 47 to the second tank 12 and the third tank 13 is generated.

At this time, since the second tank 12 and the third tank 13 are applied with a positive pressure by the first and second pumps 61 and 62 if the valves 31 and 32 are closed, the ink 19 cannot move from the fifth conduit 43, and hence is forcedly discharged from the ink discharge port 10*c* of the ink jet head 10.

According to this embodiment, the same effects as the first embodiment described above are achieved. Also, in the first embodiment, the pump 22 of the first tank 11 is necessary for the forced discharge. In contrast, according to the ink jet apparatus 2 in this embodiment, since the two first and second pumps 61 and 62 can be controlled individually to cause the forced discharge, the pump of the first tank 11 can be omitted, and the number of pumps of the entire ink jet apparatus does not change.

Since the first and second pumps 61 and 62 can be controlled individually in the ink jet apparatus 2 in this embodiment, one or both of the valves 31 and 32 may be omitted.

In the ink jet apparatus 2 of this embodiment, since the first and second pumps 61 and 62 can be controlled individually, the ink circulating flow rate in the ink jet head 10 can be increased by applying a negative pressure to both the first and second pumps 61 and 62 (feeding air from the tank to the outside). At this time, also the recycling flow of the ink stops and the ink level is deviated, it has a conceivable application which is urgently applied when foreign substances which cannot be removed are generated.

[Third Embodiment]

Figure 10:
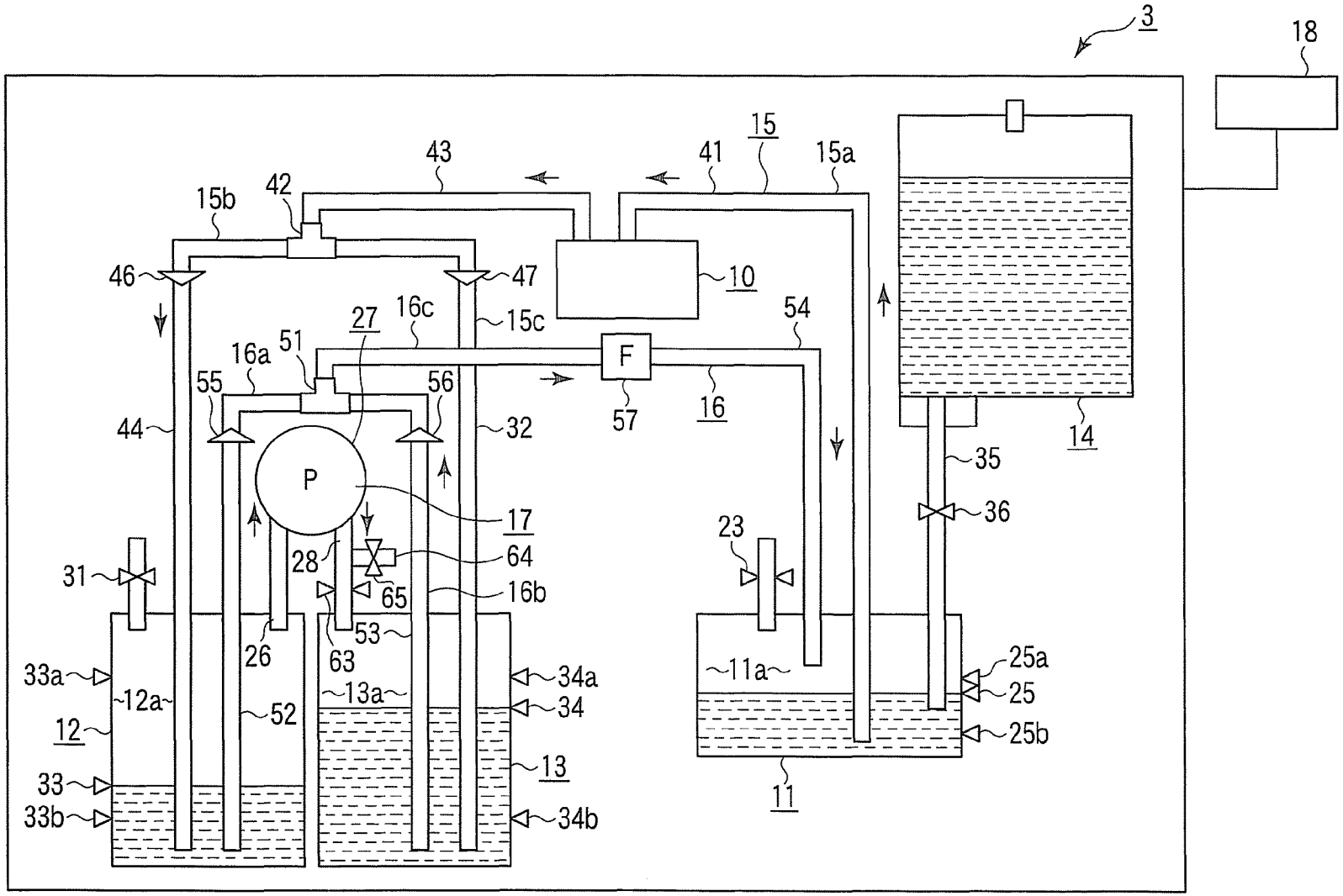
FIG. 10 is an explanatory drawing showing an ink jet apparatus according to a third embodiment.

Referring now to FIG. 10, an ink jet apparatus 3 according to a third embodiment will be described. The ink jet apparatus 3 in the third embodiment is the same as the ink jet apparatus 1 according to the first embodiment except for the configuration of the flow control mechanism 17, thus the overlapped description will be omitted.

The flow control mechanism 17 in the ink jet apparatus 3 according to this embodiment includes a valve 63 as a tank opening and closing mechanism which allows switching between the opening and blocking with respect to the tank on either one of the second conduit 26 and the third conduit 28, a conduit 64 which allows suction of the outside air between the valve 63 and the pump inlet and outlet port, and a valve 65 as a conduit opening and closing mechanism which allows switching of the conduit 64 between opening and blocking with respect to the atmospheric air in addition to the pump 27, the second conduit 26, and the third conduit 28.

Here, as shown in FIG. 10, the valve 63 which is capable of switching the state of the third tank 13 between opening and sealing with respect to the atmospheric air is provided at a midpoint of the third conduit 28 which is capable of sucking and compressing the air layer in the third tank 13. The conduit 64 which is capable of sucking the outside air is provided between the valve 63 and the pump 27. The valve 65 which is capable of switching the state of the conduit 64 between opening and blocking with respect to the atmospheric air is provided at a midpoint of the conduit 64. The valve 32 which is disposed in the ink jet apparatus 1 in the first embodiment is omitted. The valves 63 and 65 may exist on the second tank 12. In this case, the valve 31 may be omitted. The first tank 11 includes the valve 23 which is capable of opening and blocking the air layer ha to or from the atmospheric air.

In the ink jet apparatus 3 configured as described above, the same ink circulation and recycling function as in the first embodiment can be obtained by the control unit 18 issuing an instruction to open the valve 63 of the third tank 13 and bringing the valve 65 into the closed state. Opening of the third tank 13 to the atmospheric pressure is realized by the control unit 18 issuing an instruction to open the valve 63 and issuing an instruction to open the valve 65.

The ink jet apparatus 3 causes the ink jet head 10 to forcedly discharge the ink by closing the valve 63, opening the conduit 64 and the valve 65, and feeding air coming to the pump 27 from the outside air to the second tank 12 or the third tank 13 with the first tank 11 sealed and the second tank 12 and the third tank 13 also sealed.

In other words, in the operation of forcedly discharging the ink, the ink jet apparatus 3 closes the valve 23 of the first tank 11, closes the valve 31 of the second tank 12, closes the valve 63 of the third tank 13, opens the valve 65, and drives the pump 27 to feed the outside air coming from the valve 65 to the second tank 12. Then, a positive pressure is generated in the interior of the second tank 12, and a flow of the ink 19 from the second tank 12 through the back-flow blocking mechanism 55, the eighth conduit 52, the branch pipe 51, the tenth conduit 54, and the filter 57 to the first tank 11 is generated.

Since the first tank 11 is in the sealed state and hence the amount of the ink 19 increases, a positive pressure is generated in the first tank 11. Therefore, a flow from the first tank 11 through the fourth conduit 41, the ink jet head 10, the fifth conduit 43, the branch pipe 42, the sixth conduit 44, the seventh conduit 45, and the back-flow blocking mechanisms 46 and 47 to the second tank 12 and the third tank 13 is generated.

In contrast, since the second tank 12 is applied with a positive pressure by the pump 27 with the valve 31 closed, the ink 19 cannot move from the sixth conduit 44. Also, since the valve 63 of the third tank 13 is closed, the ink 19 cannot move from the seventh conduit 45. Therefore, since the ink 19 cannot move from the fifth conduit 43, it is forcedly discharged from the ink discharge port 10*c* of the ink jet head 10.

According to the ink jet apparatus 3 in this embodiment, the same effects as the ink jet apparatus 1 in the first embodiment are achieved. Also, although the two pumps are required for realizing the forced discharge in the first and second embodiments, it can be achieved with one pump according to this embodiment.

As a modified point caused by omitting the valve 31, since the valves 63 and 65 are directly connected to the pump 27, they may be affected by the flow of the pump 27. For example, if correcting the liquid level in the second tank 12, it is necessary to open the third tank 13 to the atmospheric pressure. In the third embodiment, it is realized by opening the valves 63 and 65. However, if the pump 27 is driven at this time, the branched flow might flow into the third tank 13. In order to prevent such problems, in this embodiment, the third tank 13 is not opened toward the atmospheric air if correcting the liquid level of the second tank 12, but the valve 63 is closed and the valve 65 is opened. In this configuration, the ink amount of the second tank 12 can be adjusted without changing the amount of ink in the third tank 13.

The invention is not limited to the embodiments described above. For example, in the first to the third embodiments described above, the back-flow blocking mechanisms 46, 47, 55, and 56 are arranged after the branches for the branch pipes 42 and 51. However, it may be configured in such a manner that the branch pipes 42 and 51 serve as the back-flow blocking mechanisms as pipes which are capable of selectively switching the flow channels of the branch pipes 42 and 51. In other words, it is also possible to configure the branch pipes 42 and 51 to serve as the back-flow blocking mechanisms by providing the same with a mechanism which selectively allows the flow in one direction and blocks the flow in the other direction and causing the same to operate in conjunction with the pump 27, and omit the back-flow blocking mechanisms 46, 47, 55, and 56.

In the first to the third embodiments, the ink level sensor is used as the liquid amount sensing unit, and the timing of the switching operation and the reference of the liquid level correction are determined on the basis of the liquid level. However, it is also possible to employ a sensor which measures the weight of the ink instead of the ink level sensor. In this case, the same operations as described above may be performed, for example, by providing each of the first tank 11, the second tank 12, and the third tank 13 with a weight sensor connected to the control unit 18 for measuring the weight, controlling the operation of the flow control mechanism 17 on the basis of the weight of the ink sensed by the weight sensor, and switching the flow of the air.

In the circulating system in which the loss of the pump and the flow channel resistance of the circulating system are small, so that deviation of the liquid level is small, switching simply on the basis of the time is also possible instead of the liquid amount. In other words, the same operations as described above can be achieved with the configuration in which a mechanism for measuring the time is provided in the ink circulating system and the flow of the air is switched by the pump at every certain period.

The position of the filter 57 is only an example, and it may be provided at other positions on either the first flow channel 15 or the second flow channel 16 or, for example, in the fourth conduit 41.

The number of tanks on the downstream side for collection may be two or more, or may be three or more.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An ink jet apparatus comprising:

an ink jet head;

a first tank disposed upstream of the ink jet head with respect to a flow of ink;

a second tank disposed downstream of the ink jet head with respect to the flow of ink;

a third tank disposed downstream of the ink jet head with respect to the flow of ink;

a first flow channel that connects the first tank to the ink jet head and connects the ink jet head to the second tank and the third tank;

a second flow channel that connects the first tank and the second tank without passing through the third tank and connects the first tank and the third tank without passing through the second tank; and a flow control mechanism that controls a pressure state of at least one of the second tank and the third tank.

2. The apparatus according to claim 1, comprising:

an opening and closing mechanism that opens and closes air layers in the first tank, the second tank, and the third tank with respect to the atmospheric air.

3. The apparatus according to claim 1, further comprising a control unit that controls an act of the flow control mechanism.

4. The apparatus according to claim 3, wherein the flow control mechanism includes a pump that is in communication with the air layers of the second tank and the third tank and switches the direction of gas flow.

5. The apparatus according to claim 4, wherein the flow control mechanism transfers air in either one of the second tank and the third tank to the other with the first tank opened and either one of the second and third tanks sealed, and causes circulation from the first tank to the second tank or the third tank via the first flow channel by a negative pressure in either one of the second tank and the third tank.

6. The apparatus according to claim 4, wherein the flow control mechanism transfers air in either one of the second tank and the third tank to the other with the first tank opened and either one of the second and third tanks sealed, and causes recycling from the second tank or the third tank to the first tank via the second flow channel by a positive pressure in either one of the second tank and the third tank.

7. The apparatus according to claim 6, wherein the flow control mechanism causes circulation and recycling continuously by repeatedly switching the flow direction of air between the second tank and the third tank.

8. The apparatus according to claim 5, wherein the switching operation is performed when ink is not discharged from an ink discharge port of the ink jet head.

9. The apparatus according to claim 3, wherein the flow control mechanism includes:

a tank opening and closing mechanism configured to switch the state of the air layer in the first tank between opening and blocking with respect to the atmospheric air;

a tank opening and closing mechanism configured to switch the states of the second tank or the third tank between opening and blocking with respect to the atmospheric air;

a channel which allows suction of outside air to a portion between the tank opening and closing mechanism of the second tank or the third tank and the pump; and a channel opening and closing mechanism configured to switch the states of the channel between opening and blocking with respect to the atmospheric air.

10. The apparatus according to claim 9, wherein the ink jet head is caused to forcedly discharge the ink from a discharge port of the ink jet head by sealing the first tank, the second tank, and the third tank, closing the tank opening and closing mechanism of the second tank or the third tank, opening the channel to the atmospheric air, and feeding air coming from the outside air to the second tank or the third tank.

11. The apparatus according to claim 3, wherein the flow control mechanism includes:

a first pump which has two flow ports connected at one port to the air layer in the second tank and released at the other port to the atmospheric air, and configured to switch the direction of gas flow, and a second pump which has two flow ports connected at one port to the air layer in the third tank and released at the other port to the atmospheric air, and configured to switch the direction of gas flow.

12. The apparatus according to claim 11, wherein the flow control mechanism controls the first pump and the second pump to bring the one of the second tank and the third tank to a negative pressure if the other one is at a positive pressure and bring the one of the second tank and the third tank into a positive pressure if the other one is at a negative pressure, and causes a flow of air between the second tank and the third tank.

13. The apparatus according to claim 11, wherein a positive pressure is applied to both the first and second pumps with the first tank, the second tank, and the third tank sealed.

14. The apparatus according to claim 11, wherein a negative pressure is applied to both the first and second pumps with the first tank opened, and the second and third tanks sealed.

15. The apparatus according to claim 3, comprising a liquid amount sensing unit configured to sense the liquid amounts in the second tank and the third tank, wherein the control unit controls an operation of the flow control mechanism according to a sensed result of the liquid amount sensing unit.

16. The apparatus according to claim 15, wherein the control unit corrects a liquid amount according to the sensed result of the liquid amount sensing unit.

17. A liquid circulating method comprising:

controlling a state of pressure between an air layer of a second tank disposed downstream of an ink jet head with respect to a flow of ink and an air layer of a third tank disposed downstream of the ink jet head with respect to the flow of ink by a control unit; and controlling flow of liquid in a first flow channel from a first tank disposed upstream of the ink jet head with respect to the flow of ink through the ink jet head to the second tank and the third tank, and a second flow channel from the second tank and the third tank to the first tank by the control unit.

18. A method according to claim 17, comprising: transferring gas in the second tank and the third tank to the other with the first tank opened to the atmospheric air and the second and third tanks sealed.

19. A method according to claim 17, wherein the ink jet head is caused to forcedly discharge the ink from a discharge port thereof by applying a positive pressure to an interior of the first tank with the first tank, the second tank, and the third tank sealed.

* * * * *